US008453658B2

(12) United States Patent
Morrow

(10) Patent No.: US 8,453,658 B2
(45) Date of Patent: Jun. 4, 2013

(54) PRESSURE PROGRESSING SPRAY FITTING APPARATUS

(75) Inventor: Glen E. Morrow, Center Point, IN (US)

(73) Assignee: Glen E. Morrow, Center Point, IN (US)

( * ) Notice: Subject to any disclaimer, the term of this patent is extended or adjusted under 35 U.S.C. 154(b) by 338 days.

(21) Appl. No.: 12/984,172

(22) Filed: Jan. 4, 2011

(65) Prior Publication Data

US 2011/0163180 A1 Jul. 7, 2011

Related U.S. Application Data

(60) Provisional application No. 61/292,287, filed on Jan. 5, 2010.

(51) Int. Cl.
*B08B 3/12* (2006.01)

(52) U.S. Cl.
USPC ..... 134/198; 239/63; 239/67; 137/463

(58) Field of Classification Search
USPC ..... 239/63, 66, 67, 214; 137/463, 494, 137/596.12, 596.13; 134/198, 201; 15/322
See application file for complete search history.

(56) References Cited

U.S. PATENT DOCUMENTS 3,154,090 A * 10/1964 Davis ..... 137/119.03
3,667,498 A * 6/1972 Mizuno ..... 137/119.05
3,912,167 A * 10/1975 Simon ..... 239/66
2008/0257386 A1* 10/2008 Pashley ..... 134/26

* cited by examiner

*Primary Examiner* — Len Tran
*Assistant Examiner* — Viet Le
(74) *Attorney, Agent, or Firm* — Woodard Emhardt Moriarty McNett & Henry LLP

(57) ABSTRACT

A readily expandable self-cleaning progressive spray system is provided. The system includes a fluid inlet and a series of spray fittings each having a self-sweeping spray nozzle, a timing mechanism, and a pass-through valve. The series of spray fittings are connected in fluid communication to the water inlet such that the fluid passes into and through the spray nozzle of each spray fitting until its timing mechanism expires which subsequently activates its pass-through valve which directs the fluid on to the next spray fitting. The spray fittings include a reset mechanism which resets the pass-through valves in order to allow the valves to iterate through the desired pattern again after completing one cycle.

11 Claims, 6 Drawing Sheets

PRESSURE PROGRESSING SPRAY FITTING APPARATUS

CROSS REFERENCE TO RELATED APPLICATIONS

The present application claims the benefit of U.S. Provisional Patent Application Ser. No. 61/292,287 filed Jan. 5, 2010 entitled "Pressure Progressing Spray Fitting" which is hereby incorporated by reference in its entirety to the extent not inconsistent.

FIELD OF THE INVENTION

The present invention relates generally to wastewater and related systems. In particular, the invention pertains to This invention relates to sprayers, specifically a mechanism to use pressure to spray liquid or gas in a directed path, automatically stop the spray, and reset for next cycle.

BACKGROUND OF THE INVENTION

Presently, these is a need to address the cleaning of tunnels, pipes or channels over long distances. Current methods for flushing accumulated solids include manual labor or the implementation of automated devices such as tipping buckets, flush gates, intermittent dams and vacuum flushes. Manual labor is expensive and cannot be performed with the desired frequency without significant costs and existing devices can only flush solids a limited distance before velocities are no longer able to transport the accumulated solids. Furthermore, additional devices to continue the flushing are typically not designed and installed due to complexity and cost of installing additional devices. As such, a need exists for a simple yet powerful device for flushing sediments from long runs of tunnels, pipes, or the like.

SUMMARY OF THE INVENTION

Figure 1:
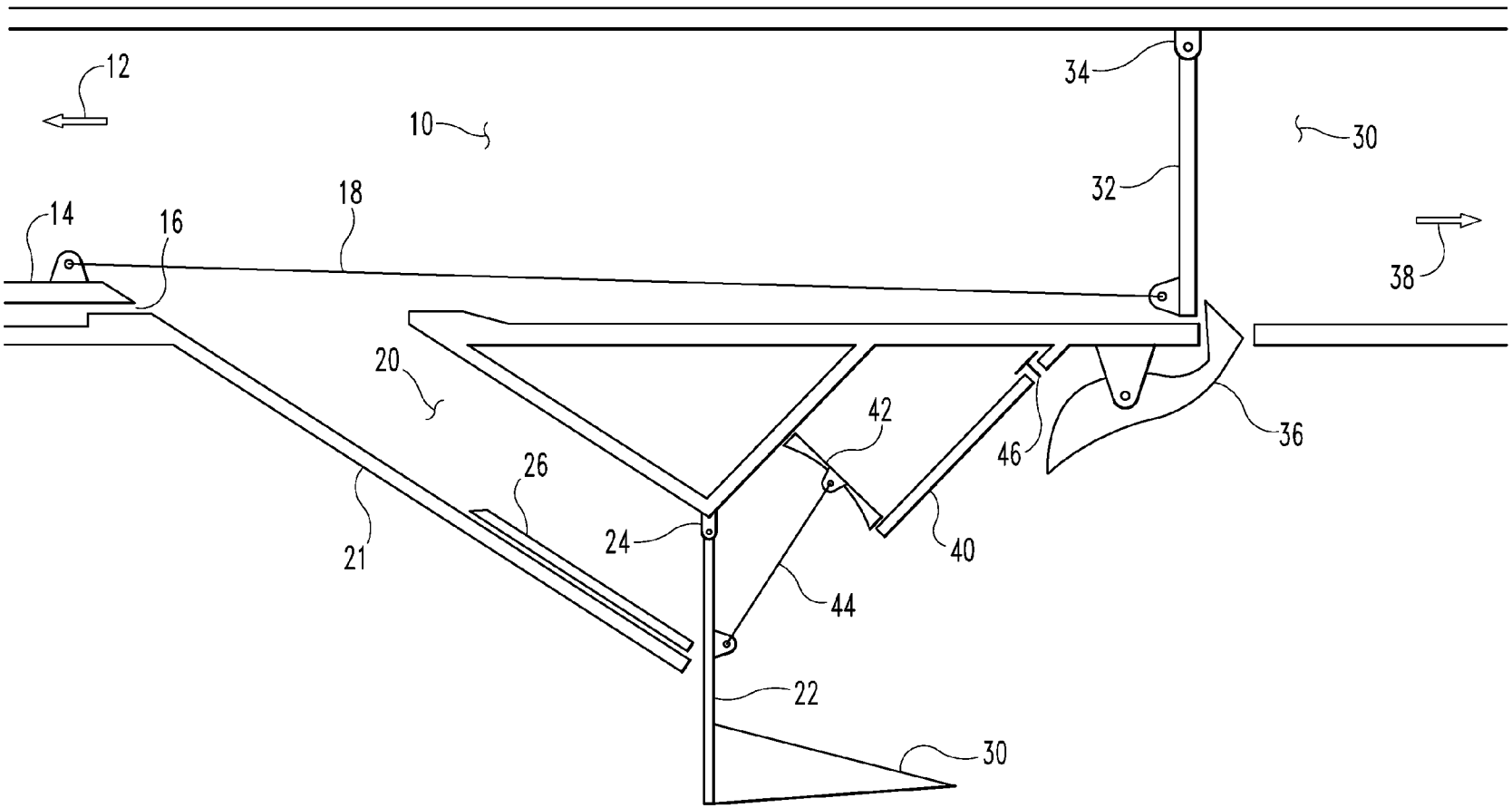
FIG. 1 illustrates a profile view of one form of a spray fitting at the start of activation.

The present disclosure includes certain embodiments for a pressure progressing spray fitting, and more particularly a cart for system and method cleaning sediment and the like from tunnels, pipes, and the like using a series of pressure progressing spray fittings. In certain embodiments of the present invention, a fitting having an inlet, a self-sweeping spray nozzle, a timing mechanism, and a pass-through valve is provided. In one form, the fittings function in series in order to provide progressive pressure to each subsequent fitting through the pass-through valves of the previous fittings. Additionally, the fittings may be automatically of manually reset for subsequent operation. The series of fittings is preferably mounted within the area to be cleaned, such as its inner top or side.

Another application for this device involves functions where long linear surfaces need to be coated with limited liquid, such as deicing solution on a runway. Existing spray systems are typically in a fixed position of on or off. If not in a fixed steady state, they rely on expensive electric or cumbersome manual controls to start and stop operation as desired.

Further objects, features and advantages of the present invention shall become apparent from the detailed drawings and descriptions provided herein. Each embodiment described is not intended to address every object described herein, and each embodiment does not include each feature described. Some or all of these features may be present in the corresponding independent or dependent claims, but should not be construed to be a limitation unless expressly recited in a particular claim.

DESCRIPTION OF ILLUSTRATIVE EMBODIMENTS

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

A progressive spray fitting 5 according to one form of the present invention is illustrated in FIG. 1. It shall be appreciated that a cleaning system for cleaning of tunnels, pipes or channels over long distances may be constructed from a plurality of spray fittings 5 connected together in series. The spray fittings may be connected together by a suitable conduit, such as pipe or the like, and spaced apart by a selected distance. The device may be constructed of any many materials including metals (cast iron, stainless steel, aluminum, copper, etc.) and plastics (polyvinyl chloride, high-density polyethylene, fiber reinforced plastic, etc.).

Turning to a description of spray fitting 5, according to one form of operating, a cycle of activation begins when pressurized liquid or gas, hereinafter referred to as fluid, enters the fitting 5 from a pipe, tube, or other pressurized system through an inlet, such as primary chute connection 12. The primary chute connection 12 may be of any known variety, such as a bell & spigot, flanged, welded connection, or the like. Furthermore, the cross section of the primary chute connection 12 may be circular, square, or any other desired cross section.

In operation, the fluid will enter the spray fitting 5 via the primary chute connection 12, or inlet, and enter the entrance chute area 10. The cross section of the entrance chute area 10 may be circular, square, or any other cross section, but preferably matches the cross section of the primary chute connection 12. The entrance chute area 10 includes two openings, the first leads to the primary chute area 20 and the second to the bypass chute 30. At this stage of operation, the fluid must flow to the primary chute area 20 because the bypass chute 30 is blocked by a closed trap door 32.

The primary chute area 20 is oriented in the direction the desired spray; however, as shown in the illustrated form, the path of the fluid may be deflected by a leading edge 22 of a spray deflector. The flow exits the device in a gap between the leading edge 22 and the trailing edge 26. The flow in the primary chute area 20 places a force on the leading edge 22 such that the leading edge 22 moves in an arc pattern around the leading edge hinge 24.

There is a counter force that prevents the rapid movement of the leading edge 22 because of the moving damper component (piston) 40. As the moving damper component (piston) 40 allows the leading edge 22 to move, the leading edge 22 pulls the trailing edge 26. The front of the trailing edge 26 stays a fixed distance from the leading edge 22 while the rear of the trailing edge 26 slides along the primary chute wall 21.

The consistent gap between the leading edge 22 and the trailing edge 26 is maintained by the trailing edge side 60. As the leading edge 22 moves, the interaction between the leading edge stud 64 and the edge side groove 66 will cause the trailing edge side 60 to move. The movement of the trailing edge side 60 is further defined by the primary chute wall groove/ridge 68 interaction with the primary chute wall 21. As the trailing edge side 60 moves, trailing edge pin 62 will pull or push the trailing edge 26.

Moving damper component 40 is illustrated as a piston, however, it shall be appreciated that other mechanisms may be utilized such as a spring or accordion valve. The moving damper component (piston) 40 is activated when the force from the fluid pushes the leading edge 22, and the piston rod 44 pushes the piston face 42. The movement of the piston face 42 is restricted by the fluid flow through a check valve 46. According, the timing of the sweep may be adjusted by adjusting the check valve 46.

Figure 2:
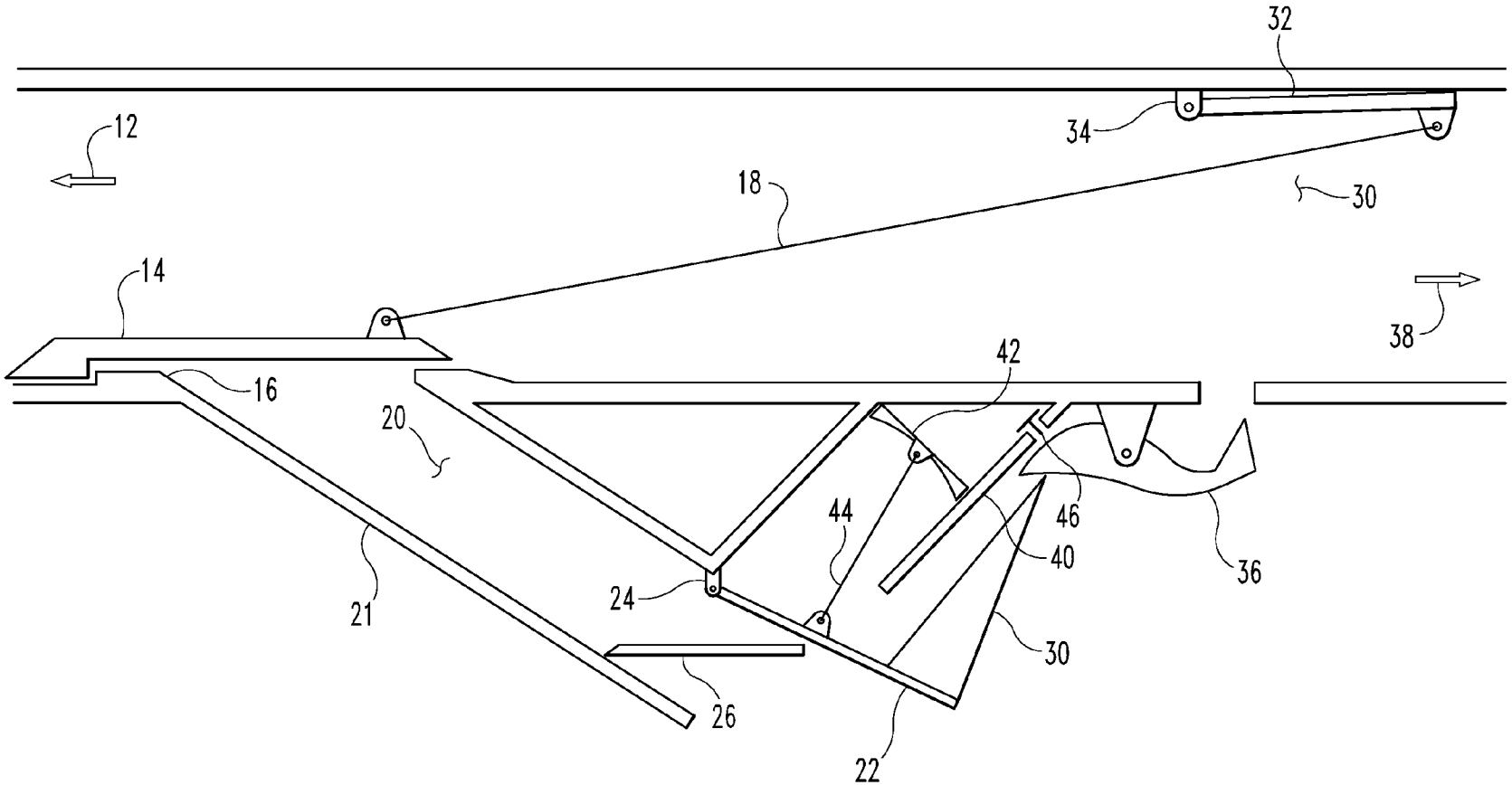
FIG. 2 illustrates a profile view of the spray fitting of FIG. 1 just after the balanced trigger latch has activated and the trap door and the primary chute cover have moved.

Turning to FIG. 2, the second stage of operation of spray fitting 5 is illustrated. As can be seen, when the leading edge 22 travels the full motion by pushing a piston rod 44 against piston face 42, a bypass chute 30 attached to the leading edge 22 will activate a balanced trigger latch 36. The balanced trigger latch 36 will release the trap door 32. Because the trap door 32 has a higher pressure on the entrance chute area 10 side, and a lower pressure on the bypass chute 30 side, the trap door 32 will travel towards the bypass chute 30 when the balanced trigger latch 36 is activated. The trap door 32 will travel in an arc pattern around the trap door hinge 34.

As the trap door 32 moves, it will pull the primary chute cover 14 with the connecting rod 18. As the primary chute cover 14 moves, it will cover the opening to the primary chute area 20. The primary chute cover 14 will stop movement when it hits the primary chute cover stop 16. When the primary chute cover 14 strikes the primary chute cover stop 16, the opening to the primary chute area 20 will be covered and all of the fluid flow to the primary chute area 20 will stop and all fluid will travel through the bypass chute 30 and past the bypass connection 38. Similar to the primary chute connection 12, the bypass connection 38 may be of any method.

Once past the bypass connection 38, the fluid may travel a pipe, tube, or other pressurized system to other like devices where they may activate as this device. Meanwhile, while the fluid is still pressurized in the bypass chute 30, the primary chute area 20 is without fluid and no longer adds a force on the leading edge 22. The force of gravity will allow the leading edge 22 to pull the piston rod 44 and piston face 42 and push the trailing edge 26 back to original positions waiting the next activation cycle.

As long as the fluid is pressurized, trap door 32 will keep the primary chute cover 14 over the hole to the primary chute area 20. When the fluid is no longer pressurized, gravity will force the trap door 32 in a downward position rotated about the trap door hinge 34 until the trap door 32 glides over the balanced trigger latch 36. This motion will push the connecting rod 18 and primary chute cover 14 back to original positions in preparation of the next cycle of activation.

Figure 3:
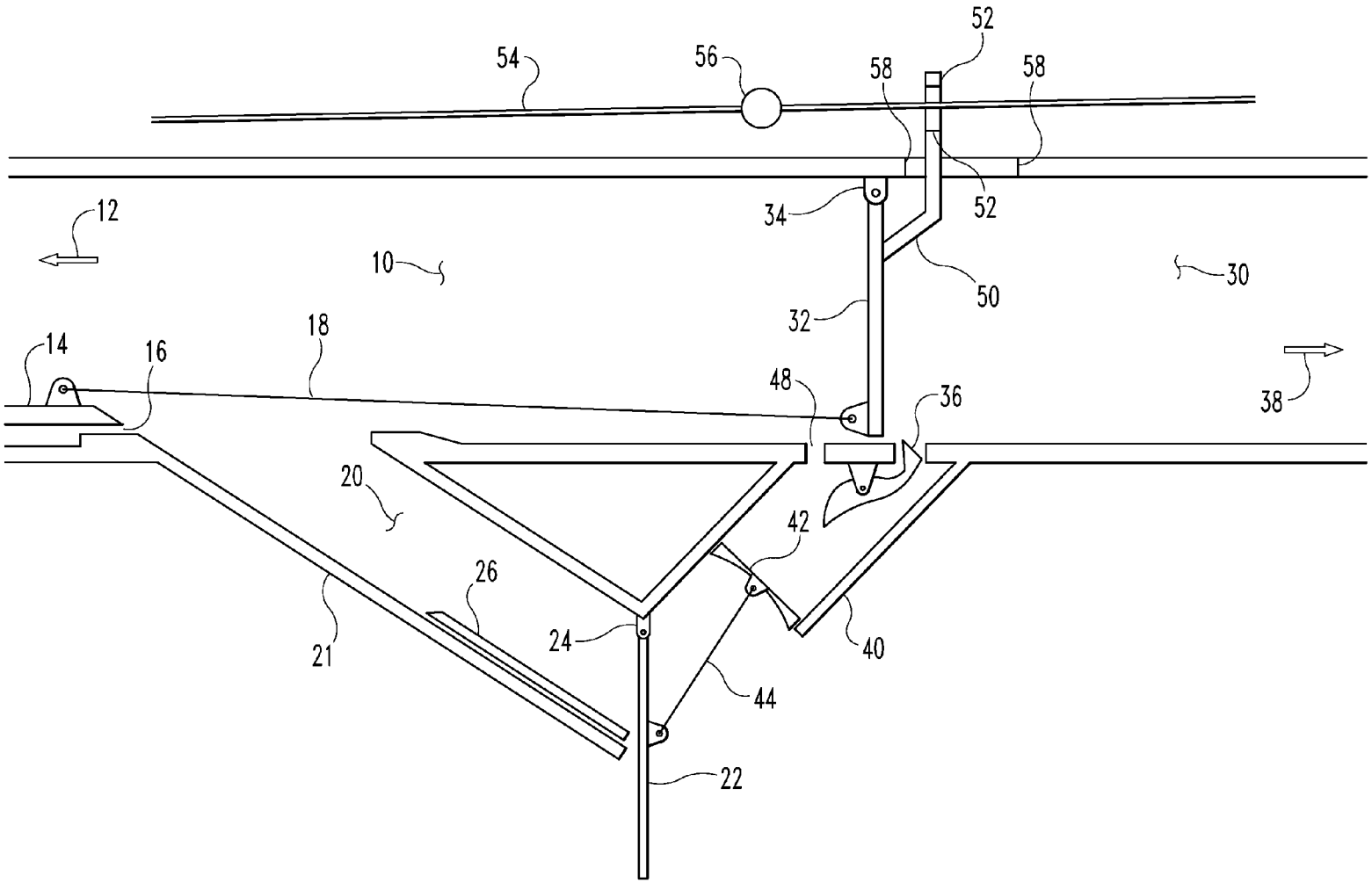
FIG. 3 illustrates a profile view of another form of a spray fitting at the start of activation.
Figure 4:
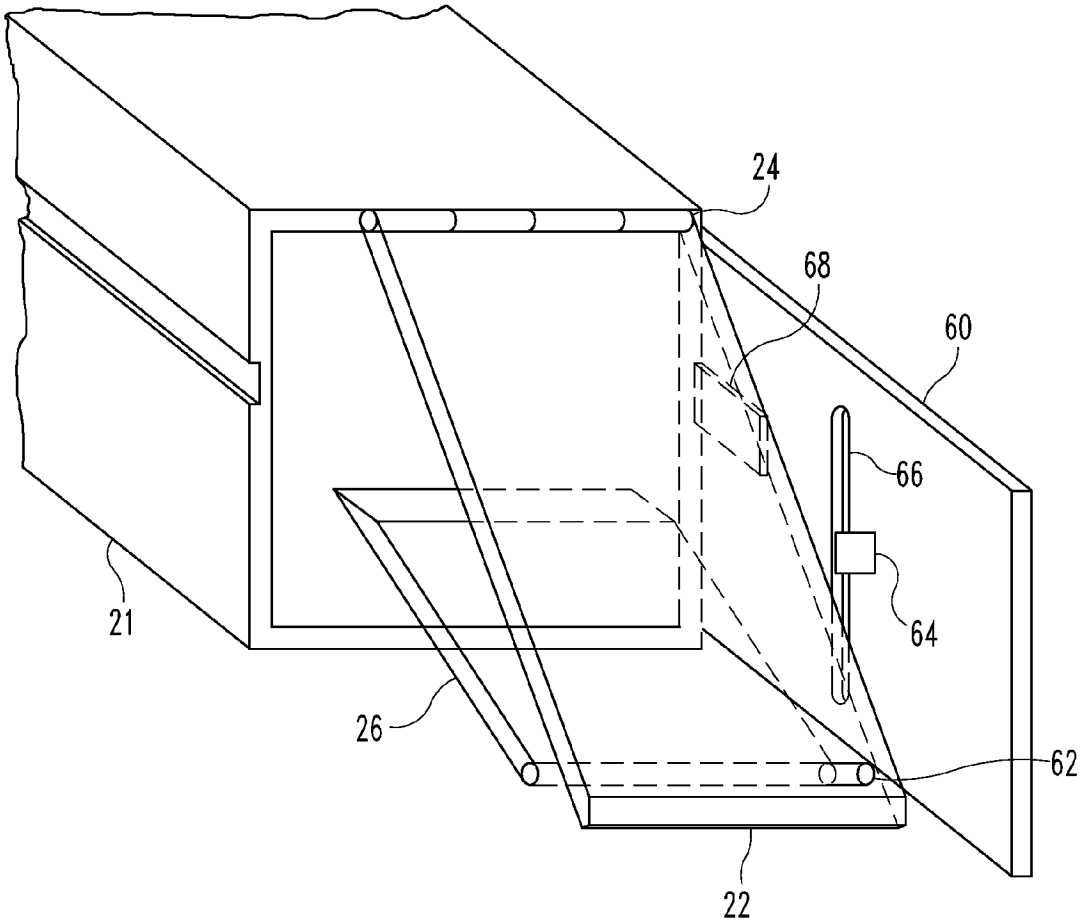
FIG. 4 illustrates a profile view of the spray fitting of FIG. 3 just after the balanced trigger latch has activated and the trap door and the primary chute cover have moved.
Figure 5A:
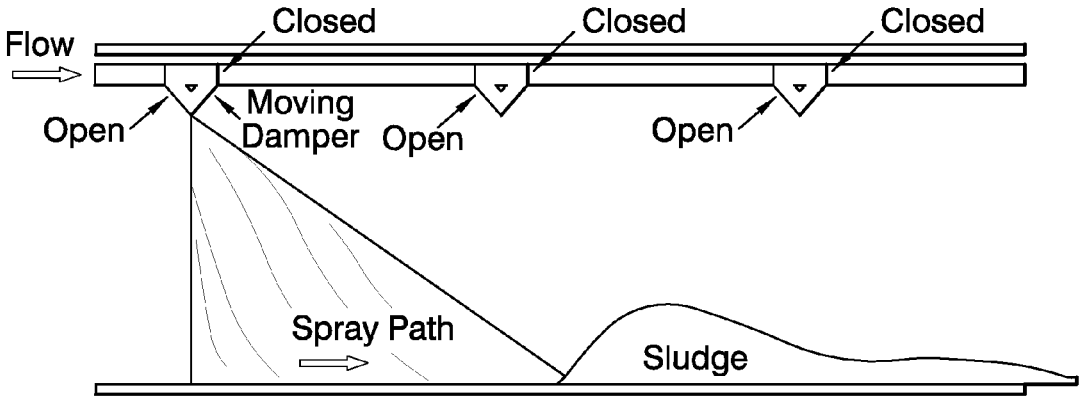
FIGS. 5 A-C illustrate how placing a plurality of spray fittings in series can clean a tunnel, pipe, channel or other application over an indefinite distance without the need for electronic controls or mechanical connections between the fittings.
Figure 5B:
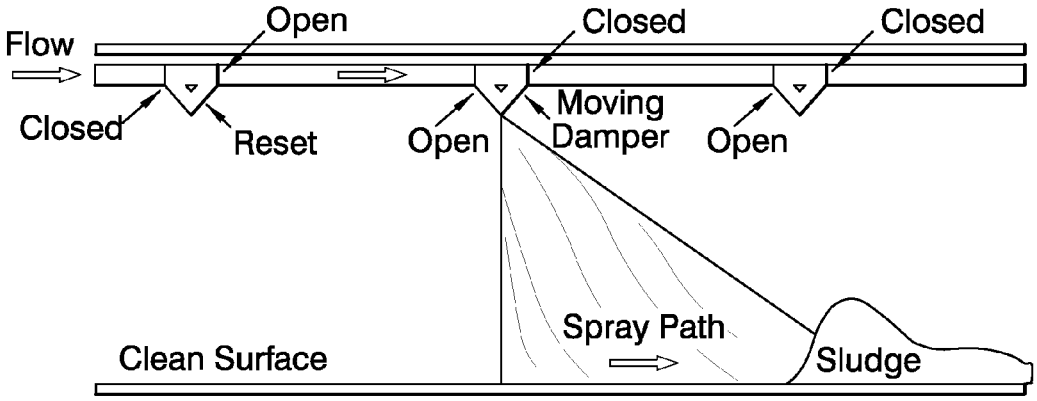
Figure 5C:
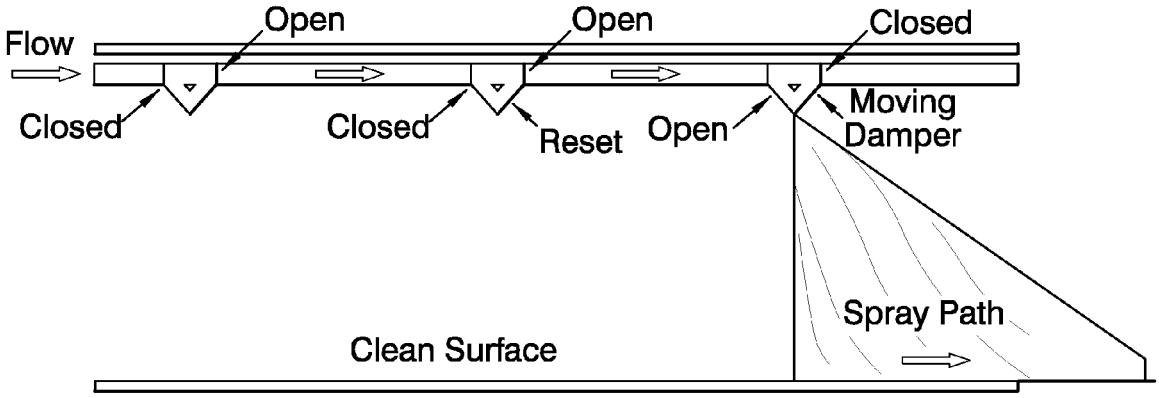

According to FIG. 3, another form of spray fitting device 5 is illustrated. In this form, the spray fitting operates similar to the described above, however, it utilizes a manual reset as opposed to the force of gravity. The cycle of activation will start when pressurized liquid or gas, hereinafter referred to as fluid, will enter the device from a pipe, tube, or other pressurized system through a primary chute connection 12.

The fluid will pass the primary chute connection 12 and enter the entrance chute area 10 and move the leading edge 22 and piston face 42. However, when the piston face 42 is moved, the piston reset hole 48 limits the fluid flow from the moving damper component (piston) 40.

According to this form, the piston face 42 is used to activate the balanced trigger latch 36, which then releases the trap door 32 that operates the connecting rod 18 and primary chute cover 14 which, as described above, seals off primary chute area 20. According to this form, the trap door 32 has a manual reset lever 50 attached that extends through a reset lever slot 58. The fluid proceeds through the bypass chute 30 past the bypass connection 38 for the same purposes describe above.

With the primary chute cover 14 covering the hole to the primary chute area 20, the pressurized fluid reverses path through the piston reset hole 48 and forces the piston face 42, leading edge 22 and related components back to original position in anticipation for the next cycle of activation.

When the entire system is finished with the cycle of activation, the fluid does not need to be depressurized. The reset cable 54 will be mechanically tensioned through the reset cable slot 52 so that the cable stopper 56 pushes the reset lever 50 into original position in anticipation for the next cycle of operation.

While the above example illustrates the principles of the invention, the characteristics of each component may vary. The cleaning needs and thus the size and pressure of various implementations will differ greatly. However, by utilizing the progressive spray fittings disclosed the user can create a solution to satisfy those needs.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A pressurized progressing spray device suitable for serial placement comprising:

a fluid supply inlet;

a supply bypass outlet in selective fluid communication with said fluid supply inlet whereby a connection to a fluid supply inlet of another pressurized spray fitting can be achieved, either directly or through a selected conduit;

a spray channel in selective fluid communication with said fluid supply inlet;

a spray directing mechanism connected to said spray channel, wherein said spray directing mechanism travels from an initial position to an end position when driven by fluid pressure;

a first trap door operable to establish a seal between said fluid supply inlet and said supply bypass outlet when in its closed state; and a second trap door operable to establish a seal between said fluid supply inlet and said spray channel when in its closed state, wherein said second trap door is connected to said first trap door such that said first trap door is always in the opposite state of said second trap door; and a damper component connected to said spray directing mechanism which slows the travel of said spray directing mechanism between said initial position and said end position, wherein said first trap door is triggered so as to switch it from its closed to its open state upon said damper component reaching said end position.

2. The pressurized progressing spray device of claim 1, wherein said first trap door resets by the force of gravity to its closed state upon a loss of fluid pressure in said fluid supply inlet.

3. The pressurized progressing spray device of claim 2, further comprising a latch which secures said first trap door in the closed position until said latch is triggered to release said first trap door into the open position by contact from said spray directing mechanism.

4. The pressurized progressing spray device of claim 2, wherein said damper component is a piston which is urged into a chamber by said spray directing mechanism forcing air from a release valve at a controlled rate.

5. The pressurized progressing spray device of claim 1, wherein said first trap door resets to its closed state upon manual activation of a reset cable.

6. The pressurized progressing spray device of claim 5, further comprising a latch which secures said first trap door in the closed position until said latch is triggered to release said first trap door into the open position by contact from said damper component.

7. The pressurized progressing spray device of claim 1, wherein said spray directing mechanism comprises at least one spray deflector plate.

8. The pressurized progressing spray device of claim 7, wherein said spray directing mechanism comprises at least two spray deflector plates which create an opening between their surfaces.

9. The pressurized progressing spray device of claim 8 wherein a first spray deflector plate in said at least two spray deflector plates is hingedly mounted to the distal end of said spray channel.

10. The pressurized progressing spray device of claim 9, wherein a second spray deflector plate in said at least two spray deflector plates is slidably mounted to the inner surface of the distal end of said spray channel.

11. A pressurized progressing spray system comprising:

a pressurized fluid source; and a plurality of spray devices connected in series at selected distances by fluid conduits to said fluid source, wherein each spray device comprises:

a fluid supply inlet;

a supply bypass outlet in selective fluid communication with said fluid supply inlet whereby a connection to a fluid supply inlet of another pressurized spray fitting can be achieved, either directly or through a selected conduit;

a spray channel in selective fluid communication with said fluid supply inlet;

a spray directing mechanism connected to said spray channel, wherein said spray directing mechanism travels from an initial position to an end position when driven by fluid pressure;

a first trap door operable to establish a seal between said fluid supply inlet and said supply bypass outlet when in its closed state; and a second trap door operable to establish a seal between said fluid supply inlet and said spray channel when in its closed state, wherein said second trap door is connected to said first trap door such that said first trap door is always in the opposite state of said second trap door; and a damper component connected to said spray directing mechanism which slows the travel of said spray directing mechanism between said initial position and said end position, wherein said first trap door is triggered so as to switch it from its closed to its open state upon said damper component reaching said end position.

* * * * *